US007302042B2

(12) United States Patent
Hansen et al.

(10) Patent No.: US 7,302,042 B2
(45) Date of Patent: Nov. 27, 2007

(54) REMOTE BLADDER VENTING AND CONTAINMENT SYSTEM

(75) Inventors: Wayne Rollins Hansen, Centerville, UT (US); Ricky Smith, Sandy, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 0 days.

(21) Appl. No.: 11/380,701

(22) Filed: Apr. 28, 2006

(65) Prior Publication Data

US 2007/0253536 A1 Nov. 1, 2007

(51) Int. Cl.
*H01J 35/10* (2006.01)

(52) U.S. Cl. ..... 378/141; 378/130

(58) Field of Classification Search ..... 378/141, 378/130, 119, 121, 127
See application file for complete search history.

(56) References Cited

U.S. PATENT DOCUMENTS 4,780,901 A 10/1988 Gabbay et al.
4,984,261 A 1/1991 Maldonado et al.
5,222,118 A 6/1993 Gerth
5,313,512 A 5/1994 Tanaka
5,357,555 A 10/1994 Gerth
5,732,123 A 3/1998 Peralta et al.
6,074,092 A 6/2000 Andrews
6,366,642 B1 * 4/2002 Andrews ..... 378/130
6,529,579 B1 * 3/2003 Richardson ..... 378/130

* cited by examiner

*Primary Examiner*—Hoon Song
(74) *Attorney, Agent, or Firm*—Workman Nydegger

(57) ABSTRACT

A system for remotely venting an expansion bladder employed in a liquid-filled container, such as an outer housing of an x-ray tube. The remote venting configuration provides the expansion bladder with access to atmospheric pressure existing about the x-ray tube so as to enable it to compensate for pressure changes within the liquid-filled container that occur as a result of liquid heating. Further, the remote nature of the bladder venting system enables the expansion bladder to be positioned within a portion of the outer housing that is radiation shielded, while the remote venting portion of the system is positioned in an unshielded portion of the housing. This eliminates the need to perforate the radiation shielding of the outer housing in order to provide atmospheric pressure to the bladder. Further, the remote vent is semi-permeable so as to prevent liquid escape from the system in the event of bladder rupture.

20 Claims, 3 Drawing Sheets

REMOTE BLADDER VENTING AND CONTAINMENT SYSTEM

BACKGROUND

1. Technology Field

The present invention generally relates to liquid cooled x-ray tube environments. More particularly, the present invention relates to bladder system for use in a liquid-filled x-ray tube that enables remote venting for the bladder while containing interior tube liquids in the event of a bladder breach.

2. The Related Technology

X-ray producing devices, such as x-ray tubes, are extremely valuable tools that are used in a wide variety of applications, both industrial and medical. For example, such equipment is commonly employed in areas such as medical diagnostic examination and therapeutic radiology, semiconductor manufacture and fabrication, and materials analysis.

Regardless of the applications in which they are employed, x-ray tubes operate in similar fashion. In general, x-rays are produced when electrons are emitted, accelerated, then impinged upon a material of a particular composition. This process typically takes place within an evacuated enclosure of the x-ray tube. Disposed within the evacuated enclosure is a cathode, or electron source, and an anode oriented to receive electrons emitted by the cathode. The anode can be stationary within the tube, or can be in the form of a rotating annular disk that is mounted to a rotor shaft which, in turn, is rotatably supported by a bearing assembly. The evacuated enclosure is typically contained within an outer housing, which also serves as a reservoir for a cooling liquid, such as dielectric oil, that serves both to cool the x-ray tube and to provide electrical isolation between the tube and the outer housing.

In operation, an electric current is supplied to a filament portion of the cathode, which causes a cloud of electrons to be emitted via a process known as thermionic emission. A high voltage potential is placed between the cathode and anode to cause the cloud of electrons to form a stream and accelerate toward a focal spot disposed on a target surface of the anode. Upon striking the target surface, some of the kinetic energy of the electrons is released in the form of electromagnetic radiation of very high frequency, i.e., x-rays. The specific frequency of the x-rays produced depends in large part on the type of material used to form the anode target surface. Target surface materials with high atomic numbers ("Z numbers") are typically employed. The target surface of the anode is oriented so that the x-rays are emitted as a beam through windows defined in the evacuated enclosure and the outer housing. The emitted x-ray beam is then directed toward an x-ray subject, such as a medical patient, so as to produce an x-ray image.

Generally, only a small portion of the energy carried by the electrons striking the target surface of the anode is converted to x-rays. The majority of the energy is rather released as heat. It is critical to remove excess heat produced during x-ray production to prevent failure of the x-ray tube. One common method in dissipating heat involves submerging the evacuated enclosure in a dielectric cooling liquid which, as explained above, is contained within a reservoir defined by the outer housing. The cooling liquid assists in absorbing heat from the evacuated enclosure that is produced therein during x-ray production and dissipating it to the surrounding environment. Such dissipation can be accomplished, for example, via conductive heat transfer between the cooling liquid and the surface of the outer housing. In this way, the operating temperature of the x-ray tube is maintained within acceptable levels.

In many liquid-filled x-ray tubes, one or more expansion bladders are employed in order to maintain a relatively consistent liquid pressure within the reservoir at or near atmospheric pressure ("1 atm"). These expansion bladders are flexible and include a first surface in liquid communication with a portion of the cooling liquid as well as a second surface that is in communication with the tube exterior such that it is subject to atmospheric pressure. During tube operation, heat created as a result of x-ray production is absorbed by the cooling liquid. Absorption of this heat causes the volume of the cooling liquid to expand. In response to this volume expansion, the expansion bladder contracts, thereby expanding the relative size of the reservoir, which relatively reduces the pressure of the cooling liquid.

Similarly, when cooling of the liquid occurs, its volume and corresponding pressure decrease. Expansion of the expansion bladder is then triggered, which reduces the liquid reservoir volume, thereby relatively increasing cooling liquid pressure. The expansion bladder is configured and operated in this manner to maintain the cooling liquid pressure at or near 1 atm (atmospheric pressure) during tube operation, notwithstanding the cyclical temperature changes of the cooling liquid. This in turn enables the fluid-tight seals of the x-ray tube outer housing to be configured for mere liquid containment, and not for liquid containment at elevated pressures relative to atmospheric pressure. This consequently reduces both the complexity and cost of x-ray tube seals, thereby offering added savings for tube manufacturing.

Despite their utility in maintaining constant cooling liquid pressure, several challenges nevertheless exist with respect to expansion bladder use. Many of these challenges relate to the unintended rupture or other failure of the expansion bladder. When such failure occurs, escape of cooling liquid past the expansion bladder can result. Further, because many tube designs require that the expansion bladder be exposed to atmospheric pressure and therefore lack a fluid-tight seal about the entirety of the expansion bladder, cooling liquid that escapes past the bladder can also spill from the x-ray tube entirely. Such spillage is highly undesirable. As can be imagined, liquid escape from the x-ray tube not only presents a contamination problem, but can also be hazardous by presenting a health risk to tube users, patients, or others in close proximity to the x-ray tube.

In particular, x-ray tubes are often employed in connection with medical x-ray scanning devices, such as CT scanners. An x-ray tube utilized in a CT scanner is often mounted on a rotating gantry that achieves high rotational rates during scanning operations. Should the expansion bladder of a CT scanner x-ray tube so positioned fail during use, extensive cooling liquid leakage and dispersal from the tube can occur, resulting in exposure to the local environment, users, patients, etc. As described above, cooling liquid often possesses significant quantities of absorbed heat, which can present a burn risk to those persons who may be exposed to the liquid. Furthermore, some cooling liquids are caustic or otherwise hazardous substances, thereby representing an additional contamination risk. For these and other reasons, expansion bladder failure and its attendant consequences are to be avoided.

In an effort to reduce the effects of expansion bladder failure, some known x-ray tubes hermetically seal the expansion bladder off within the outer housing and isolate it from atmospheric pressure influences. Though this alleviates liquid containment problems should the expansion bladder fail, it nevertheless represents a significant additional expense in manufacturing such tubes, as all fluid-tight seals used in the outer housing must be designed to withstand the elevated pressure that results from such a tube design.

Another attempt at avoiding the above challenges has involved tubes that employ a dual expansion bladder system, wherein a first expansion bladder is backed by a backup second expansion bladder in the outer housing of the x-ray tube. Though this dual expansion bladder design can in certain cases enhance the safety of the x-ray tube in the event of a single expansion bladder failure, both expansion bladders must still be subject to atmospheric pressure, and therefore are still susceptible to the above undesirable consequences should failure of both expansion bladders occur. Further, a dual expansion bladder system is necessarily more complex than a single expansion bladder system, thereby equaling greater production costs and more complication when tube servicing is required, as well as creating more possible failure points, given the extreme operating conditions in which x-ray tubes are often utilized.

Still other challenges are presented with regard to x-ray tube expansion bladders. One of these involves the use of radiation shielding in the x-ray tube. Most x-ray tubes contain some form of shielding to prevent the emission of x-rays from the tube except where intended. Often, such shielding includes a lead lining that is attached to a portion of the outer housing that is susceptible to unintended x-ray emission. This notwithstanding, design constraints often dictate that expansion bladders be positioned within the outer housing at locations that are preferably to be shielded by the lead lining. However, because of the general requirement for the bladder to be exposed to atmospheric pressure, a gap must often be made in the shielding layer in order to enable a portion of the bladder to be exposed to the atmosphere. As a result, additional shielding configurations must be employed in order to compensate for the shielding gap made necessary by the expansion bladder. This translates into increased complexity and cost for the x-ray tube design.

In light of the above, a need exists for an x-ray tube having an expansion bladder system that avoids the above problems. In particular, an x-ray tube having an expansion bladder system that protects from cooling liquid escape in the event of bladder failure is needed. Such a solution should be adaptable to different x-ray tube types and other apparatus without substantially increasing the complexity thereof. Any solution should also alleviate the need for comprising radiation shielding measures of an x-ray tube in order to position the expansion bladder for proper operation. Additionally, any solution should not interfere with the operation of the expansion bladder in maintaining a constant cooling liquid pressure within the x-ray tube.

SUMMARY OF EXAMPLE EMBODIMENTS

The present invention has been developed in response to the above and other needs in the art. Briefly summarized, embodiments of the present invention are directed to a system for remotely venting an expansion bladder employed in a liquid-filled container, such as an outer housing of an x-ray tube. The remote venting configuration provides the expansion bladder with access to atmospheric pressure existing about the x-ray tube so as to enable it to compensate for pressure changes within the liquid-filled container that occur as a result of liquid heating. Further, the remote nature of the bladder venting system enables the expansion bladder portion to be positioned within a region of the outer housing that is radiation shielded, while the remote venting portion of the system is positioned in an unshielded region of the housing. This eliminates the need to perforate the radiation shielding of the outer housing in order to provide atmospheric pressure to the bladder. Further, a remote vent feature can be provided that is semi-permeable; this prevents liquid escape from the system in the event of bladder rupture.

In one exemplary embodiment, an x-ray tube is disclosed that comprises an outer housing defining an interior volume that contains a coolant, such as a cooling liquid, and an evacuated enclosure that is disposed within the interior volume so as to be in fluid communication with the coolant. The evacuated enclosure contains an electron source and an anode positioned to receive electrons produced by the electron source. The x-ray tube further includes an expansion bladder that is contained within the outer housing. In an example embodiment, the expansion bladder is formed with an outer surface that defines an interior volume. At least a portion of the outer surface is in fluid communication with the coolant. An atmospheric access point such as a vent, access hole or port is provided in the outer housing to provide atmospheric access to the interior volume of the expansion bladder by way of an air passageway that is also disposed within the interior of the housing. In an illustrated embodiment, the vent hole is formed in a region of the outer housing that is not x-ray shielded. Hence, atmospheric pressure is provided to the bladder without interfering with the x-ray shielding requirements of the x-ray tube housing. In addition, the x-ray tube preferably includes means for preventing fluid from escaping through the atmospheric access point, such as might occur in the event of a bladder rupture or failure. This means for preventing can be provided, for example, by way of a semi-permeable membrane (or similar structure, depending on the venting requirements) that is disposed within the opening formed through the outer housing. The membrane (or similar structure) functions to expose the interior volume of the expansion bladder to the atmosphere outside of the housing, and yet prevents the escape of coolant.

Thus, an x-ray tube environment is provided in a manner such that pressure fluctuations within the tube can be accommodated via an expansion bladder and venting system. However, this pressure compensation is provided in a manner that does no negatively affect the x-ray shielding properties of the x-ray tube, thereby insuring the safety and imaging capabilities of the tube. Moreover, the venting system incorporates additional safety features that minimize the risk of coolant escaping from the x-ray tube in the event of bladder failure.

These and other features and advantages of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof that are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF SELECTED EMBODIMENTS

Reference will now be made to figures wherein like structures will be provided with like reference designations. It is understood that the drawings are diagrammatic and schematic representations of exemplary embodiments of the invention, and are not limiting of the present invention nor are they necessarily drawn to scale.

Figure 1:
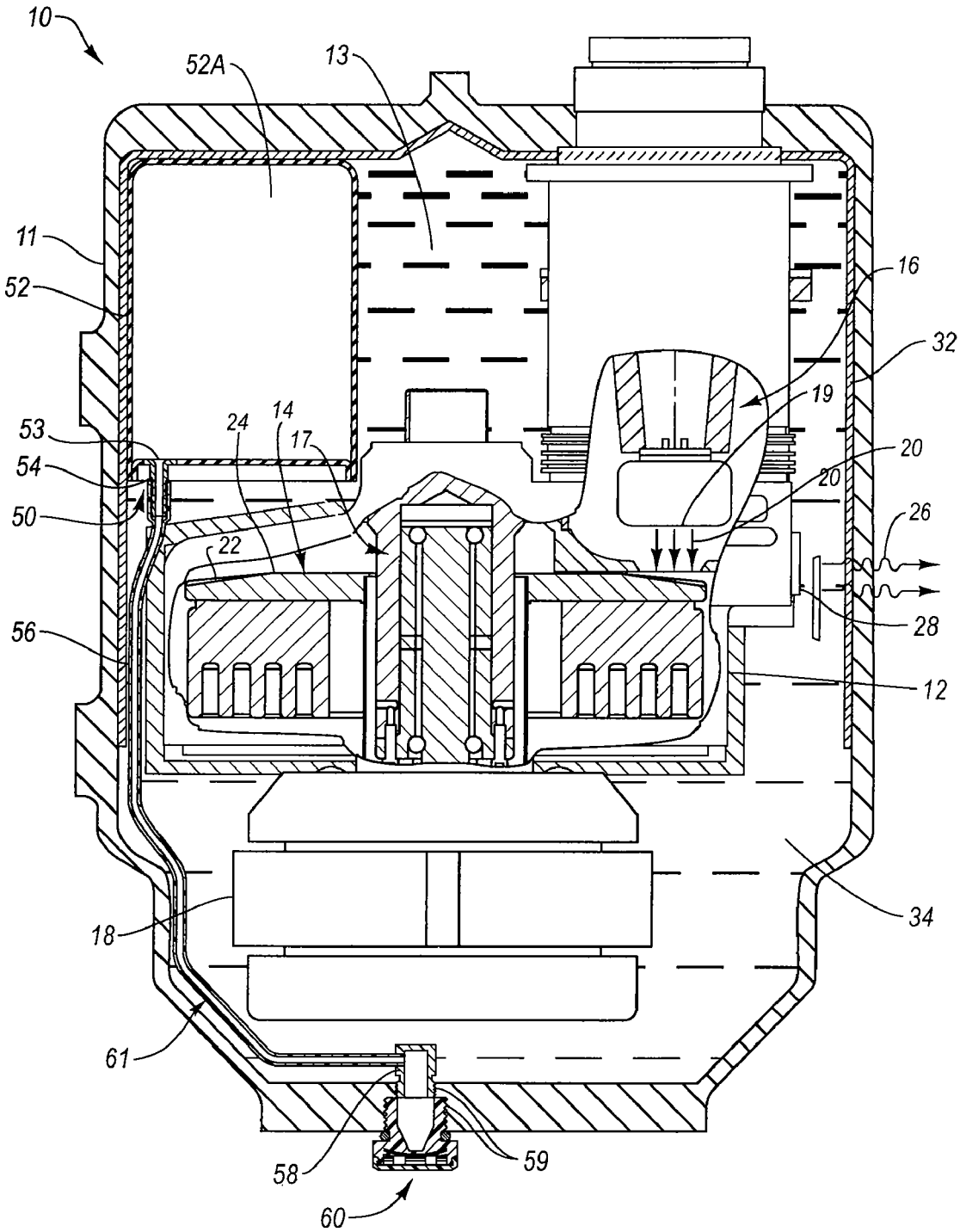
FIG. 1 is a simplified cross sectional view of an exemplary x-ray tube environment including a remote venting and containment system for an expansion bladder, according to one embodiment of the present invention.
Figure 2:
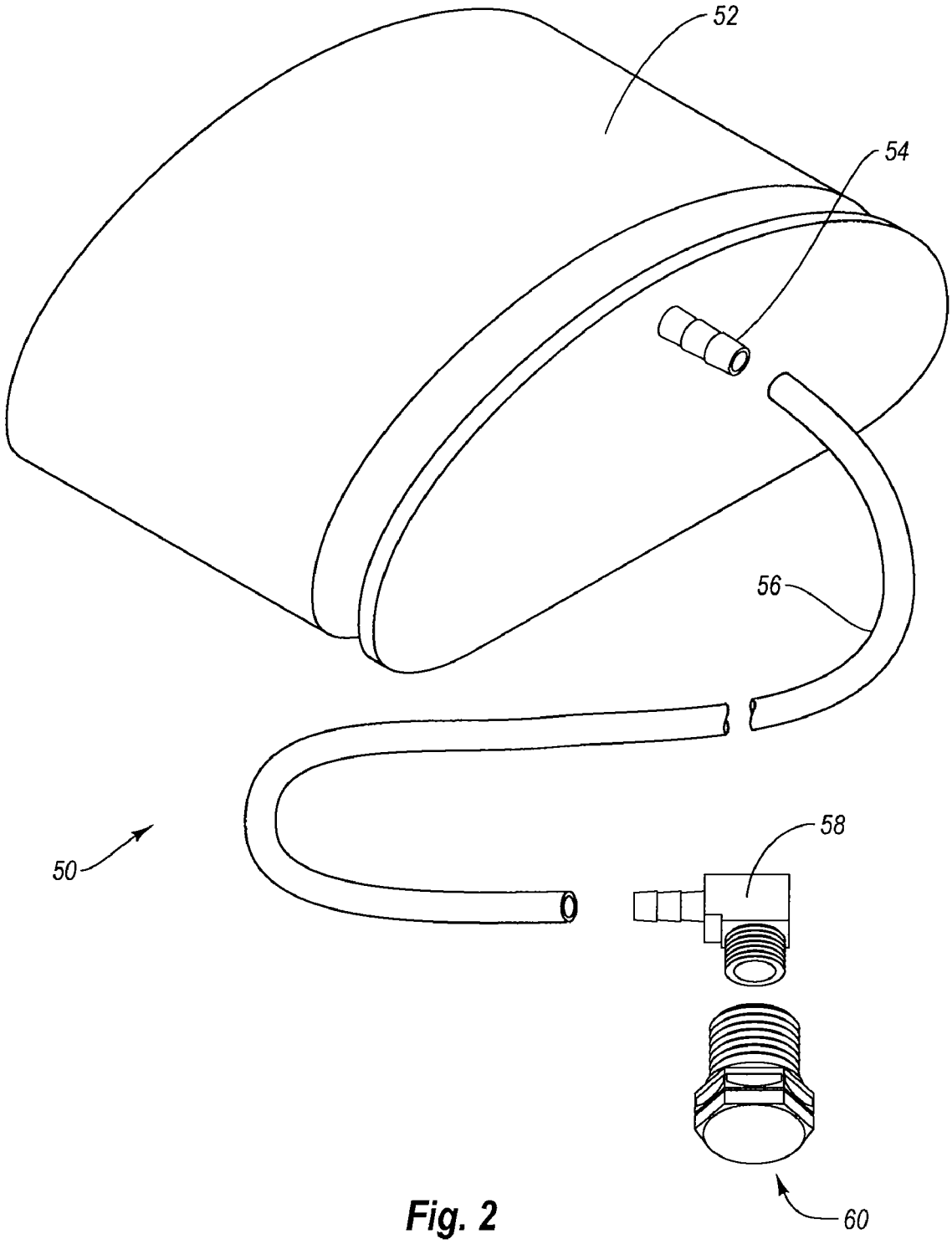
FIG. 2 is an exploded view of the bladder venting and containment system of FIG. 1.
Figure 3:
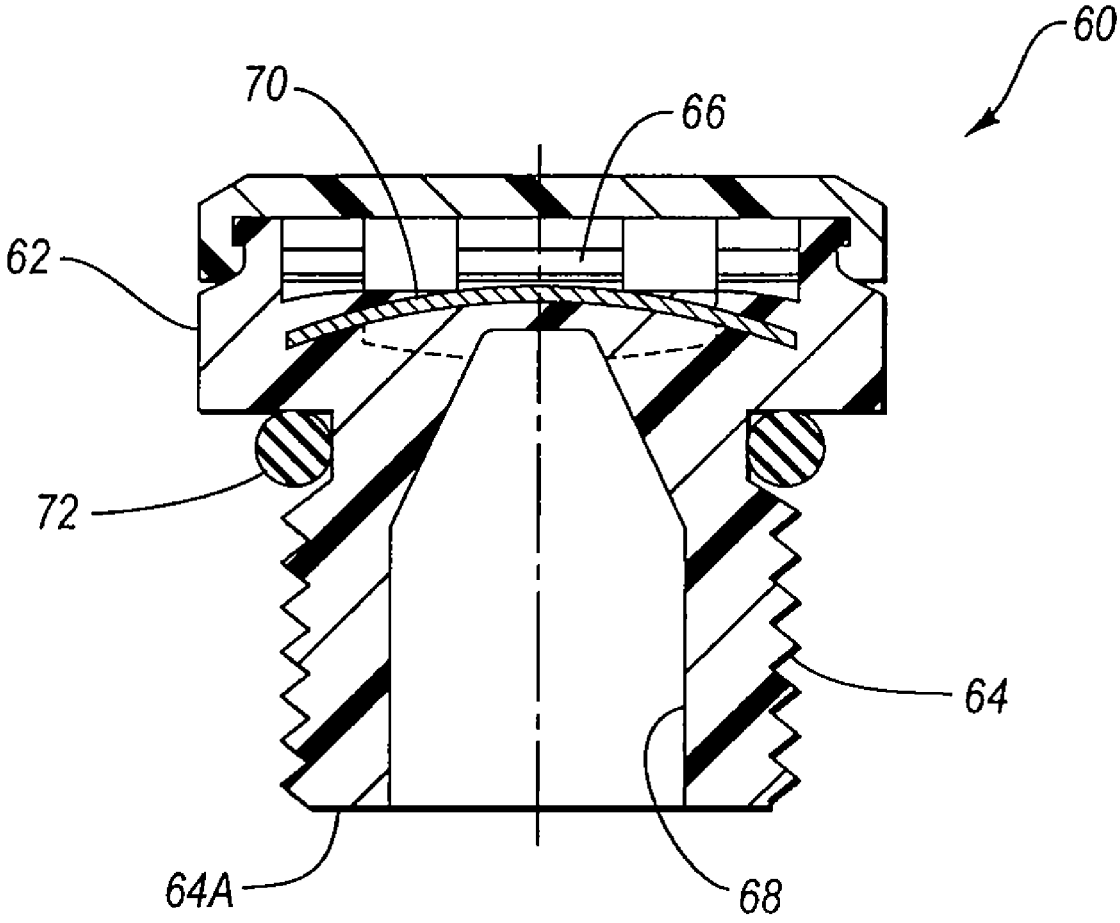
FIG. 3 is a cross sectional view of a semi-permeable membrane seal plug used in connection with one embodiment of the remote bladder venting and containment system.

FIGS. 1-3 depict various features of embodiments of the present invention, which is generally directed to a system for venting an expansion bladder employed in fluid-filled containers, such as an outer housing of an x-ray tube containing a cooling liquid. The venting configuration provides the bladder with access to atmospheric pressure existing about the x-ray tube so as to enable it to compensate for pressure changes within the cooling liquid-filled outer housing container that occur as a result of liquid heating. Further, in an illustrated embodiment, the orientation and configuration of the bladder venting system enables the bladder to be positioned within a portion of the outer housing that is radiation shielded, while the venting portion of the system is positioned in an unshielded housing portion. Such a configuration eliminates the need to perforate the radiation shielded portion of the outer housing in order to provide atmospheric pressure to the bladder.

Moreover, embodiments of the invention provide liquid containment features for the bladder venting system. In an example embodiment, a semi-permeable membrane is included with the venting portion of the system. The membrane is substantially permeable to air, but does not permit (or at least substantially minimizes) the transmission of cooling liquid. In the event of rupture or failure of the bladder, any cooling liquid that enters the bladder and advances to the remotely disposed venting portion is prevented from escaping the outer housing by the membrane, thereby preventing a possible source of hazardous contamination.

As used herein, the terms "coolant," "fluid" and "liquid" are understood to encompass flowable substances that tend not to disperse and that are relatively incompressible. As used with regard to x-ray tubes herein, the terms are also understood to encompass any one of a variety of substances that can be employed in cooling and/or electrically isolating an x-ray or similar device. Examples include, but are not limited to, de-ionized water, insulating liquids, and dielectric oils. Further, while embodiments of the present invention described herein are concerned with integration of a remote bladder venting and containment system into a bladder-equipped x-ray tube, it is appreciated that the system as explained herein can be employed with bladders that compose part of other apparatus as well. Thus the discussion to follow is merely exemplary of the manner in which the present invention can be practiced.

Reference is first made to FIG. 1, which illustrates a simplified structure of a rotating anode-type x-ray tube, designated generally at 10. X-ray tube 10 includes an outer housing 11, within which is positioned an evacuated enclosure 12. A cooling liquid 13 is also disposed within the outer housing 11, enveloping and in liquid communication with the evacuated enclosure 12, to assist in tube cooling and to provide electrical isolation between the evacuated enclosure and the outer housing. In one embodiment, the cooling liquid 13 is a dielectric oil, which provides desirable thermal and electrical insulating properties. The cooling liquid 13 can be sealed in the outer housing 11, as shown in FIG. 1, or can be circulated to and from the outer housing within a cooling liquid circulation system (not shown) for purposes of heat removal.

As shown in the partial cutaway view of FIG. 1, positioned within the evacuated enclosure 12 are a rotating anode 14 and a cathode 16. The anode 14 is spaced apart from and oppositely disposed to the cathode 16, and is at least partially composed of a thermally conductive material such as copper or a molybdenum alloy. Specifically, the anode 14 is rotatably supported by a rotor assembly 17. The rotor assembly 17 provides rotation of the anode 14 during tube operation via a rotational force provided by a stator 18.

The cathode 16 includes a filament 19 that is connected to an appropriate power source such that during tube operation, an electrical current is passed through the filament to cause electrons, designated at 20, to be emitted from the cathode by thermionic emission. Application of a high voltage differential between the anode 14 and the cathode 16 causes the electrons 20 emitted from the filament 19 to accelerate from the cathode toward a focal track 22 that is positioned on a target surface 24 of the rotating anode 14. The focal track 22 is typically composed of tungsten or a similar material having a high atomic ("high Z") number. As the electrons 20 accelerate, they gain a substantial amount of kinetic energy, and upon striking the target material on the focal track 22, some of this kinetic energy is converted into electromagnetic waves of very high frequency, i.e., x-rays 26, shown in FIG. 1.

A significant portion of the x-rays 26 produced at the anode target surface is oriented such that the x-rays pass through a window 28 positioned in the evacuated enclosure 12 and are emitted from the outer housing 11. The x-rays 26 can then be used for a variety of purposes, according to the intended application. For instance, if the x-ray tube 10 is located within a medical x-ray imaging device, such as a CT scanner, the x-rays 26 emitted from the x-ray tube are directed for penetration into an object, such as a patient's body during a medical evaluation for purposes of producing a radiographic image of a portion of the body.

As mentioned, the x-ray tube 10 includes the cooling liquid 13 that is utilized to ensure proper cooling and electrical isolation of the evacuated enclosure 12 during tube operation. As such, the structure of the outer housing 11 defines a reservoir 34 for containing the cooling liquid 13.

A portion of the inner surface of the outer housing 11 includes a layer of radiation shielding 32. The shielding 32 is positioned on the inner housing surface so as to substantially prevent the unintended emission of x-rays from the x-ray tube 10. A slot can be defined in the shielding 32, however, to allow intended passage of the x-rays 26. In one embodiment, the shielding 32 includes a layer of lead that is attached to the inner surface of the outer housing 11. Other substances could also be used to attenuate the passage of x-rays.

In the example of FIG. 1, the shielding 32 is positioned on only an upper portion of the x-ray tube 10, as this portion is subject to substantial x-ray impingement. In contrast, the lower portion of the x-ray tube 10 receives less x-ray impingement, and is therefore left unshielded, and thus is more transmissive to x-rays.

During tube operation, heat that is created as a result of x-ray production originates largely in the anode 14 and is radiated by the anode to the exterior portions of the evacuated enclosure 12. This heat is then absorbed by the cooling liquid 13 that envelops the exterior of the evacuated enclosure 12. Following absorption, the cooling liquid 13 can transfer the heat to the outer housing 11 via convection and conduction processes, which heat can then be removed from the x-ray tube 10 via known processes. In this way, proper operating temperature of the x-ray tube 10 can be maintained. As mentioned, the cooling fluid in other tube configurations can be continuously circulated in and out of the tube by a closed loop cooling system via the use of fluid lines, a pump, and a heat exchanger (not shown), for example.

More generally, it is appreciated that the cooling configurations discussed above are merely exemplary of cooling systems that can be employed in an x-ray tube. As such, cooling systems that vary from that described herein, or that include additional or alternative components, can also be used in connection with the present invention.

As shown in FIG. 1, the x-ray tube 10 further includes a bladder venting system ("venting system"), generally depicted at 50. The venting system 50 is employed in the x-ray tube 10 to provide proper operation of an expansion bladder 52, which forms part of the system, while avoiding problems common to expansion bladder configurations in the art, as were described above. In addition to the bladder 52, the venting system 50 further includes, among other components, an air passage tube 56 and a membrane seal plug 60, to be described in further detail below.

Together with FIG. 1, reference is also made to FIG. 2. By way of overview, the venting system 50 is configured to enable proper bladder operation by providing exposure of the bladder to atmospheric pressure from the exterior of the outer housing 11 (i.e., "venting"), which enables the bladder to contract and expand with respect to the various pressure changes of the cooling liquid 13 within the reservoir 34 during tube operation. Further, and in accordance with embodiments of the present invention, the venting system 50 is configured to enable placement of the bladder 52 in the outer housing 11 without regard to the radiation shielding 32, which typically must be modified or otherwise compromised in order to enable proper atmospheric pressure access to the bladder. Moreover, embodiments of the present invention provide containment functionality for the bladder in the event of rupture or other failure of the bladder caused by rotation-induced dynamic loading, etc.

Note that, though shown connected to an x-ray tube having a particular configuration shown in FIG. 1, the venting system 50 is adaptable such that it can be utilized in connection with various types of x-ray tubes, including single-ended, double-ended, rotary anode, stationary anode tubes, etc. In addition, use of the venting system 50 is not limited to x-ray tubes only. Indeed, other systems utilizing bladder-based liquid or liquid cooling systems can also benefit from the principles of the diaphragm sealing system as discussed herein. Therefore, the discussion to follow should not be interpreted as limiting the present invention in any way.

As seen in FIG. 1, the bladder 52 is positioned within the interior reservoir volume 34 defined by the outer housing 11, and as such the bladder is in fluid communication with the cooling liquid 13 also disposed therein. The bladder 52 is included in the x-ray tube 10 in order to preserve the cooling liquid 13 at or near atmospheric pressure (i.e., "1 atm") within the reservoir 34 during tube operation. As is known, the cooling liquid 13 absorbs heat from the evacuated enclosure 12 and dissipates that heat via the surface of the outer housing 11.

During this cooling cycle, however, the temperature of the cooling liquid can rise or fall according to the current level of heat absorption by the liquid. As the cooling liquid 13 increases in temperature, the volume of the cooling liquid correspondingly increases, thereby causing the bladder 52 to collapse with respect to the reservoir 34, thereby reducing an air-filled interior volume 52A of the bladder 52 and in turn expanding the relative size of the reservoir. Expansion of the reservoir 34 causes the pressure of the heated cooling liquid 13 to decrease, thereby maintaining the cooling liquid pressure relatively constant.

Similarly, when cooling of the cooling liquid 13 occurs, contraction in the volume and pressure of the cooling liquid causes a consequent expansion of the bladder 52 and its interior volume 52A in order to reduce the volume of the reservoir 42 and maintain the pressure of the cooling liquid at or near 1 atm. As has been mentioned, use of a bladder within the x-ray tube 10 in this manner simplifies tube construction by negating the need for pressure seals in the outer housing 11, which correspondingly saves manufacturing costs.

The bladder 52 shown in FIGS. 1 and 2 is of a two-piece design, though integrally formed, balloon-type bladders are also acceptable. In a multiple-piece bladder design, the various bladder pieces can be hermetically joined to one another via an adhesive such as rubber glue, welds, or other suitable means.

The bladder 52 includes an opening 53 that is in communication with its air-filled interior volume 52A. A male outlet fitting 54 is positioned at the opening 53 and is received by an end of the air passage tube 56, which defines an air passageway that is in communication with the bladder opening 53. The air passage tube 56 in the illustrated embodiment is a flexible hose that serves as a conduit between the bladder interior 52A and the membrane seal plug 60. As it is immersed in the cooling liquid 13, the air passage tube 56 should be composed of materials that will not degrade in the presence of the cooling liquid, which in some cases is composed of caustic dielectric oils. Further, the air passage tube material should be capable of withstanding the elevated temperatures present within the outer housing 11 during tube operation. In one embodiment, acceptable air passage tube materials include natural and synthetic rubber. Though it can be rigidly formed, in the present embodiment the air passage tube 56 is flexible so as to promote ease of placement in the outer housing during tube assembly.

The considerations discussed above regarding material requirements of the air passage tube 56, i.e., resistance to caustic oils and heat, substantially apply to the bladder 52 as well. In addition, the bladder material should be flexible enough to enable repetitive bladder compression and expansion in connection with its operation within the outer housing 11. As such, in one embodiment the bladder 52 is also composed of natural or synthetic rubber, though other materials meeting the above characteristics can be alternatively employed.

As mentioned above, one end of the air passage tube 56 is coupled to the outlet fitting 54 positioned at the opening 53 of the bladder 52. The other end of the air passage tube 56 receives a male ended portion of a housing fitting 58. The housing fitting 58 defines an air passageway therethrough and is composed of metal or other suitable material. The housing fitting 58 is threadably engaged with a hole 59 defined in the outer housing 11 to serve as an interface for the air passage tube 56 with the outer housing.

The housing fitting 58 is positioned so as to abut the membrane seal plug 60 that is also threadably engaged in the hole 59 of the outer housing 11. Like the housing fitting 58, the membrane seal plug 60 defines an air passageway therethrough. In the example embodiment, a portion of the membrane seal plug 60 extends beyond the outer surface of the outer housing 11. So configured, the air passage tube 56, the housing fitting 58, and the membrane seal plug 60—being in communication with one another as described above—together define an air path 61 between the exterior of the outer housing 11 and the interior volume 52A of the bladder 52 so as to provide atmospheric pressure to the bladder and enable proper operation of the bladder.

Note that the above components that define the air path described above are merely exemplary of the aim to provide an atmospheric pressure air path, to the bladder 52, together with enabling the other features of the present invention. It is therefore appreciated that modifications and alterations with respect to the components used to define the air path can be realized while preserving the intended functionality. For instance, the housing fitting can be omitted in one embodiment such that the air passage tube interfaces directly with the membrane seal plug. In another embodiment, the threaded end of the housing fitting does not abut the membrane seal plug but is threadably engaged therewith. The above description should therefore not be meant to limit the present invention in any way.

The membrane seal plug 60 includes a semi-permeable membrane, to be discussed below, that assists in exposing the bladder to atmospheric pressure via the air path 61, i.e., venting, and for preventing the passage of the liquid via the air path. As such, the semi-permeable membrane provides protection against cooling liquid leakage from the x-ray tube 10 in the event of rupture or other failure of the bladder 52. Moreover, positioning of the membrane seal plug 60 at a location that is relatively distant from the bladder, i.e., remote positioning, enables complications regarding compromise of the radiation shielding 32 by the bladder 52 to be overcome, as will be seen.

Reference is made to FIG. 3, which depicts various features of the membrane seal plug 60. The membrane seal plug 60 shown in FIG. 3 is exemplary of similar products manufactured under the name of GORE™ membrane vents by W.L. Gore & Associates, Inc.

As shown, the membrane seal plug 60 of the example embodiment generally includes a head 62 and a stem 64 having a plurality of threads 64 defined thereon for threadingly engaging the membrane seal plug with the correspondingly threaded portion of the hole 59 of the outer housing 11 (FIG. 1). In one embodiment, the head 62 and stem 64 are composed of polyamide. The head 62 includes a plurality of vents 66 defined therein that are in communication with a central bore 68 defined through the stem 64. An O-ring 72 is positioned about the membrane seal plug 60 at the interface of the head 62 with the stem 304 in order to create a fluid-tight seal with the hole 59 when the membrane seal plug is threadingly engaged therein. Alternatively, the stem 64 of the membrane seal plug 60 can be smooth and can be adhesively attached to the hole. Thus, other avenues for attaching the membrane seal plug 60 to the outer housing 11 are also contemplated.

As shown in FIG. 3, a semi-permeable membrane 70 is interposed between the plurality of vents 66 and the bore 68 so as to form a semi-permeable barrier in the air path 61. The semi-permeable membrane 70 is positioned such that air, other gases, or vapor must pass through the membrane in order to enter or exit the air path 61.

In accordance with one embodiment, the semi-permeable membrane 70 is composed of GORE™ membrane, manufactured by W.L. Gore & Associates, Inc. GORE™ membrane is composed of a microporous, expanded PTFE membrane that is naturally hydrophobic and oleophobic to repel water and oil, while still being permissive to the passage of air, other gases, and vapors therethrough. As will be seen, a semi-permeable membrane such as GORE™ membrane enables the bladder venting system 50 (FIG. 1) to operate as described herein. As such, the GORE™ membrane described herein is but one example of a semi-permeable membrane that can be utilized in connection with the venting system 50. Indeed, other semi-permeable membranes can alternatively be utilized in connection with the principles of the present invention. Properties of such alternative membranes include hydrophobic and oleophobic properties, with the added ability to allow air, other gases, and vapors to pass therethrough.

The size of the semi-permeable membrane can be varied according to the needs of a particular application. In particular, both the thickness and amount of exposed surface area of the semi-permeable membrane should be sufficient to enable sufficient air transfer between the exterior of the tube outer housing 11 and the bladder interior volume 52A so as to enable the bladder to respond to changes in cooling liquid pressure quickly enough to avoid the build-up of back pressure. Correspondingly, the size and other features of the membrane seal plug and the portion of the hole 59 in the outer housing 11 receiving the plug can be modified so as to provide adequate infrastructure for placement of a semi-permeable membrane having the proper size for adequate air flow to the bladder 52. In other embodiments, multiple semi-permeable membranes and/or membrane seal plugs can be disposed in the venting system. In yet another embodiment, the semi-permeable membrane can be employed without the membrane seal plug. In such an instance, the semi-permeable membrane could be adhesively applied, or otherwise secured, to the outer surface of the outer housing 11 so as to cover the hole 59, for example.

As mentioned above, the membrane seal plug 60 is remotely positioned with respect to the bladder 52. In particular, FIG. 1 shows the bladder 52 positioned within the reservoir 34 relatively near the target surface 24 of the anode 14. In contrast, the membrane seal plug 60 is remotely positioned beyond the stator 18, with the air path 61 defined therebetween by the air passage tube 56. Inspection of FIG. 1 will reveal that the bladder 52 is positioned within the region of the outer housing 11 having the layer of radiation shielding 32, while the membrane seal plug is positioned where no shielding is present. In this position, the membrane seal plug 60 can create an access point, or vent, for atmospheric pressure for the bladder 52 without penetrating or removing a portion of the shielding 32 to provide direct atmospheric pressure access to the bladder. Thus, by virtue of the remote position of the membrane seal plug with respect to the bladder, no structural compromise of the outer housing x-ray shielding is required. This in turn allows for an integral shielding configuration for the outer housing to prevent unintended x-ray emission from portions of the x-ray tube prone to such emission. Moreover, manufacture of the x-ray tube is made simpler, due to the fact that additional x-ray shielding features are not required to be added to the tube in order to compensate for perforation or alteration of the radiation shielding.

Note that various possible positions for placement of the membrane seal plug exist that are sufficiently remote, i.e., not positioned in a portion of the outer housing where perforation of the shielding is required. Accordingly, various considerations can influence the particular placement of the membrane seal plug, including ease of manufacture, accessibility in the event of repair or replacement of the membrane seal plug, etc. With respect to the bladder, size and design limitations typically prevent flexibility with respect to bladder placement. Advantageously, the present invention overcomes this limitation by enabling bladder positioning without regard to direct atmospheric pressure access by virtue of the indirect relationship between the bladder and the atmospheric pressure access point.

In accordance with another aspect of the present invention, the membrane seal plug 60 is configured to prevent leakage of cooling liquid during tube operation. Should an unanticipated failure of the bladder 52 occur, such as a tear of the bladder material, cooling liquid 13 will spill into the interior volume 52A of the bladder 52 and proceed along the air path 56. Progress of cooling liquid 13 past the membrane seal plug 60 is prevented, however, by the semi-permeable membrane 70 of the membrane seal plug 60, which prevents the passage of liquid, as has been described.

In particular, the semi-permeable membrane 70 is hydrophobic and oleophobic, and is therefore substantially non-transmissive to water and oil-based cooling liquids 13. Thus, any cooling liquid incident on the semi-permeable membrane 70 is contained within the air path 61, thereby preventing any cooling liquid escape to the outside of the outer housing 11. In this way, complications or hazards arising from the escape of the cooling liquid 13 from the x-ray tube 10 due to an unanticipated failure of the bladder 52 are prevented. At the same time, it is seen that the semi-permeable membrane 70 of the membrane seal plug 60 operates as desired in allowing atmospheric air pressure to pass through the plug to the bladder interior volume 52A via the air path 61, thereby enabling the bladder to maintain the pressure of the cooling liquid 13 at or near 1 atm, or other predetermined pressure.

As shown and described in the embodiments disclosed herein, the semi-permeable membrane 70 serves as one exemplary means for substantially preventing fluid from escaping through the atmospheric access point, such as might occur in the event of a bladder rupture or failure, but still allows for atmospheric pressure access to the interior volume of the expansion bladder. As noted above, however, other materials or structures can alternatively serve as a means for performing this function. For example, other semi-permeable membranes or structures composed of a material other than GORE™ could be employed—depending on the venting needs and requirements of a particular application. Thus, the description included herein should not be construed as limiting of the present invention.

The present invention may be embodied in other specific forms without departing from its spirit or essential characteristics. The described embodiments are to be considered in all respects only as illustrative, not restrictive. The scope of the invention is, therefore, indicated by the appended claims rather than by the foregoing description. All changes that come within the meaning and range of equivalency of the claims are to be embraced within their scope.

What is claimed is:

1. An x-ray tube, comprising:

an outer housing containing a coolant;

an evacuated enclosure disposed in the outer housing so as to be at least in partial fluid communication with the coolant, the evacuated enclosure containing an electron source and an anode positioned to receive electrons produced by the electron source;

an expansion bladder contained within the outer housing, the expansion bladder defining an interior volume;

a port defined in the outer housing and configured to provide atmospheric pressure access to the interior volume of the expansion bladder via an air passageway; and wherein the port is positioned within a region of the outer housing that is substantially x-ray transmissive.

2. The x-ray tube as defined in claim 1, further comprising means for substantially preventing coolant contained within the housing from escaping through the port.

3. The x-ray tube as defined in claim 2, wherein the means for substantially preventing allows the transmission of air, gases, and vapors.

4. The x-ray tube as defined in claim 2, wherein the means for substantially preventing comprises a semi-permeable membrane.

5. The x-ray tube as defined in claim 4, wherein the semi-permeable membrane is included within a membrane seal plug that is received within the port defined in the outer housing.

6. The x-ray tube as defined in claim 1, wherein the air passageway is a tube extending between the interior volume of the expansion bladder and the port.

7. The remote expansion bladder venting system as defined in claim 1, wherein the coolant is continuously circulated in and out of the x-ray tube housing.

8. A remote expansion bladder venting system suitable for use in an x-ray tube, comprising:

an expansion bladder positioned within a first region of an x-ray tube housing, the first region being substantially non-transmissive to x-rays, the bladder having an exterior surface in contact with a coolant disposed within the housing;

a vent provided in a second region of the x-ray tube housing, the second region being substantially transmissive to x-rays, the vent being in communication with atmospheric pressure; and an air passageway that interconnects an interior volume of the expansion bladder with the vent so as to enable the expansion bladder to be subject to atmospheric pressure.

9. The remote expansion bladder venting system as defined in claim 8, wherein the vent includes a semi-permeable portion such that the vent is substantially transmissive to air but substantially non-transmissive to the coolant.

10. The remote expansion bladder venting system as defined in claim 9, wherein the semi-permeable portion is comprised of a microporous, expanded PTFE membrane.

11. The remote expansion bladder venting system as defined in claim 8, wherein the air passageway is at least partially defined by a tube that extends between an opening in the expansion bladder interior and the vent.

12. The remote expansion bladder venting system as defined in claim 11, wherein the tube extends from an outlet fitting included at the opening in the expansion bladder interior to a housing fitting included in a surface of the housing in the second region.

13. The remote expansion bladder venting system as defined in claim 8, wherein the coolant is a dielectric oil.

14. An x-ray tube, comprising:

an outer housing that defines an interior volume containing a coolant;

a radiation shielding layer included on a portion of the outer housing;

an evacuated enclosure contained in the outer housing and having an outer surface in communication with the coolant, the evacuated enclosure containing an electron source and an anode positioned to receive electrons produced by the electron source; and a remote bladder venting system, comprising:

an expansion bladder contained within the portion of the outer housing that includes the radiation shielding layer, the expansion bladder having an outer surface that is in communication with the coolant;

a semi-permeable membrane that is in communication with and substantially transmissive of atmospheric pressure, the semi-permeable membrane being positioned proximate a portion of the outer housing that does not include the radiation shielding layer; and an air passage extending at least partially between the expansion bladder and the semi-permeable membrane such that an interior volume of the expansion bladder is subject to atmospheric pressure.

15. The x-ray tube as defined in claim 14, wherein the semi-permeable membrane is substantially non-transmissive of liquid so as to preclude leakage of the cooling liquid rupture of the tube or expansion bladder.

16. The x-ray tube as defined in claim 14, wherein the semi-permeable membrane is included in a membrane seal plug that is received in a hole defined in the outer housing.

17. The x-ray tube as defined in claim 14, wherein the air passage and the expansion bladder are composed of rubber.

18. The x-ray tube as defined in claim 16, wherein a fitting is interposed between an end of the air passage and the membrane seal plug, the fitting and the air passage defining an air passageway between the interior volume of the expansion bladder and the membrane seal plug.

19. The x-ray tube as defined in claim 14, wherein placement of the membrane seal plug precludes the need for modifying the lead shielding in order to subject the expansion bladder to atmospheric pressure.

20. The x-ray tube as defined in claim 14, wherein the radiation shielding layer surrounds the anode and the expansion bladder, and wherein the membrane seal plug is positioned proximate a stator of the x-ray tube.

* * * * *